US009475609B2

(12) United States Patent
Huber

(10) Patent No.: US 9,475,609 B2
(45) Date of Patent: Oct. 25, 2016

(54) PALLET ADAPTER KIT AND LOADING UNIT WITH CORRESPONDING PALLET ADAPTER KIT

(71) Applicant: Telair International GmbH, Miesbach (DE)

(72) Inventor: Thomas Huber, Schliersee (DE)

(73) Assignee: Telair International GmbH (DE)

( * ) Notice: Subject to any disclaimer, the term of this patent is extended or adjusted under 35 U.S.C. 154(b) by 21 days.

(21) Appl. No.: 14/513,706

(22) Filed: Oct. 14, 2014

(65) Prior Publication Data

US 2016/0039568 A1 Feb. 11, 2016

(30) Foreign Application Priority Data

Aug. 6, 2014 (DE) ..... 10 2014 111 200

(51) Int. Cl.
*B60P 7/13* (2006.01)
*B65D 19/44* (2006.01)
*B65D 19/00* (2006.01)

(52) U.S. Cl.
CPC ..... *B65D 19/44* (2013.01); *B65D 19/0002* (2013.01); *B65D 19/0077* (2013.01); *B65D 2203/10* (2013.01); *B65D 2519/0099* (2013.01); *B65D 2519/00273* (2013.01); *B65D 2519/00293* (2013.01); *B65D 2519/00567* (2013.01); *B65D 2519/00572* (2013.01); *B65D 2519/00815* (2013.01); *B65D 2519/00985* (2013.01)

(58) Field of Classification Search
CPC ..... B60P 7/13; B60P 7/132
USPC ..... 410/46, 35, 80
See application file for complete search history.

(56) References Cited

U.S. PATENT DOCUMENTS

| | | | | |
|---|---|---|---|---|
| 3,543,951 | A * | 12/1970 | Marvin | 206/503 |
| 5,183,375 | A * | 2/1993 | Fenton et al. | 410/35 |
| 5,193,253 | A * | 3/1993 | Janke et al. | 24/287 |
| 6,027,291 | A * | 2/2000 | Sain et al. | 410/35 |
| 6,210,088 | B1 * | 4/2001 | Crosby | 410/35 |
| 6,224,307 | B1 * | 5/2001 | Johnson et al. | 410/89 |
| 6,427,947 | B1 | 8/2002 | Rohrlick et al. | |
| 6,793,448 | B2 * | 9/2004 | Sain | 410/46 |
| 6,877,939 | B2 * | 4/2005 | Tomkins et al. | 410/46 |
| 7,011,479 | B2 * | 3/2006 | Sain | 410/46 |
| 7,125,212 | B2 | 10/2006 | Moore et al. | |

(Continued)

FOREIGN PATENT DOCUMENTS

| | | |
|---|---|---|
| DE | 60306765 | 7/2007 |
| EP | 581072 | 7/1993 |
| WO | 03/091131 A2 | 11/2003 |

OTHER PUBLICATIONS

Concise Explanation of EP 581072, Telair International GmbH.

*Primary Examiner* — Hilary Gutman
(74) *Attorney, Agent, or Firm* — Barnes & Thornburg LLP

(57) ABSTRACT

A pallet adapter kit for aircraft cargo pallets, with a plurality of beams each with a top side and an underside, wherein the beams comprise at least one peg beam which on the underside comprises a first peg receiver and a second peg receiver each for receiving a peg, and on the top side a first beam peg and a second beam peg for engagement in container corners, in particular corners of ISO containers, wherein the first beam peg is arranged offset in relation to the first peg receiver and/or the second beam peg is arranged offset in relation to the second peg receiver in the longitudinal direction of the peg beam.

13 Claims, 5 Drawing Sheets

(56) References Cited

U.S. PATENT DOCUMENTS 8,262,328 B2 * 9/2012 Crane et al. ..... 410/46
8,534,969 B2 * 9/2013 Guo et al. ..... 410/46
2012/0312920 A1 * 12/2012 Huber et al. ..... 244/118.1
2013/0145593 A1 * 6/2013 Holzner et al. ..... 29/401.1

* cited by examiner

PALLET ADAPTER KIT AND LOADING UNIT WITH CORRESPONDING PALLET ADAPTER KIT

BACKGROUND

The invention concerns a pallet adapter kit for aircraft cargo pallets and a loading unit with a cargo pallet and a corresponding pallet adapter kit.

It is known to attach standard large-volume containers, such as are often used for transporting goods on ships and trucks, onto aircraft cargo pallets so that the large-volume containers can be transported in wide-bodied aircraft. Often, these large-volume containers (also called ISO containers or intermodal containers) comply with a standard, for example ISO standard 668. In the lower region at least, the ISO containers have standardized container corners. Often, the upper corners of the container are also standardised. These standardised corners are used to receive pegs for simple loading and fixing on a truck or correspondingly equipped ship. Furthermore, the containers can be connected together via corresponding adapters for ease of stacking.

U.S. Pat. No. 6,427,947 discloses fixing the entire loading surface of a truck, with container arranged thereon, to aircraft cargo pallets so that a complete truck load can be loaded. Here the loading surface of the truck functions as a type of adapter between the cargo pallets and the containers.

Although the cargo holds of modern wide-bodied aircraft are becoming ever larger, it is still difficult to accommodate in the aircraft ISO containers which are also becoming ever larger. Because of the rounding of the aircraft fuselage, the height of the containers constitutes a particular problem. The containers must be placed on the cargo pallets very carefully to prevent damage to the aircraft skin. Furthermore, great care is required when fixing the freight containers to the pallets or directly to the cargo deck of the aircraft, since any slippage of the load can have catastrophic effects.

Often, ISO containers are secured using loading nets and straps. Correct attachment of the loading straps and nets is very time-consuming, which delays the loading and unloading processes.

SUMMARY

Starting from this state of the art, the present invention is based on the object of providing a pallet adapter kit for efficient loading of ISO containers on aircraft cargo pallets. The pallet adapter kit allows corresponding containers to be loaded into the aircraft quickly and easily, making maximum use of the loading space available and guaranteeing safe transport.

This object is achieved by the pallet adapter kit and by a loading unit.

The object is achieved in particular by a pallet adapter kit for aircraft cargo pallets which has a plurality of beams, each with a top side and an underside. The beams comprise at least one peg beam which on the underside comprises a first peg receiver and a second peg receiver, each for receiving a peg, and on the top side a first beam peg and a second beam peg for engagement in container corners, in particular in corners of ISO containers, wherein the first beam peg is arranged offset in relation to the first peg receiver and/or the second beam peg is arranged offset in relation to the second peg receiver in the longitudinal direction of the peg beam.

It is known to equip aircraft cargo pallets with suitable pegs which can engage in the corners of ISO containers. In this way the containers are placed directly above the aircraft cargo pallet. The pallet adapter kit according to the invention allows the ISO container to be arranged "offset". This means that the container can be placed on the pallet so that it protrudes laterally beyond this (transversely to the longitudinal axis of the aircraft cargo pallet). To this extent, the longitudinal axis of the ISO container in top view no longer lies directly above the longitudinal axis of the cargo pallet, but is offset transversely.

Provision of the peg receivers and beam pegs on the peg beam has the advantage that a form-fit connection can be created between the pallet and the peg beam, and between the peg beam and the container. The result is an indirect form-fit connection between the cargo pallet and the ISO container. This form-fit connection can be created very simply, and it effectively prevents a slippage of the load in relation to the aircraft cargo pallet.

Because of the offset loading of the ISO container on the cargo pallet, very high containers—for example of the 1 CC type to ISO 668 or so-called "High Cubes"—can be loaded. The pallet adapter kit according to the invention here utilizes the circumstance that unused space is normally available in the region of the centre guides (centre latches) of the cargo deck. Due to the offset arrangement, the ISO container protrudes beyond the cargo pallet into this region. Where applicable, the offset may be sufficiently large for the freight container to protrude into an adjacent freight loading track, i.e. beyond the centre guides. This is not a problem however since smaller cargo pallets or aircraft containers can be loaded there accordingly.

In one exemplary embodiment, the offset amounts to more than 3%, in particular more than 5%, in particular more than 10% of the total length of the peg beam. The first beam peg can be arranged offset in relation to the first peg receiver and/or the second beam peg can be arranged offset in relation to the second peg receiver by at least 3% or by at least 5% or by at least 10%. This offset preferably relates to the total length of the peg beam. Alternatively, the offset can also relate to the width of the container or cargo pallet.

The peg receiver can be configured to receive pegs which are constructionally identical to the beam peg. Theoretically it is conceivable to take account of different peg systems in configurations of the beam peg and the peg receivers of the peg beam. Preferably the beam peg is configured such that identical systems are used. To this extent, the cargo pallet can be configured such that small ISO containers can be attached directly onto this. Large ISO containers can then be attached only with the pallet adapter kit according to the invention.

In one embodiment, the pallet adapter kit furthermore comprises support beams. These support beams are preferably arranged between a pair of peg beams. The function of the support beams is to support the floor of the freight container and transfer any forces occurring to the aircraft cargo pallet. Furthermore the support beams may be suitable for attaching fixing means, for example lashing straps or nets.

According to the invention, it is possible to omit the provision of further beams between the peg beams. In this case however the problem arises of attaching the lashing straps or nets suitably to the cargo pallet. According to the invention, for this fixing devices, in particular perforated rails or seat rails, may be provided on the side of the cargo pallet, in particular on the vertical part thereof.

In one exemplary embodiment, the plurality of beams comprises at least one, preferably two support beams with a top side and an underside, wherein at least one fixing device is provided for fixing lashing straps to the top side of the support beam. The fixing device may be a perforated rail or a part segment of a perforated rail. Many fixing devices used in aviation are designed for corresponding perforated rails. The support beams may be dimensioned such that they protrude beyond the offset ISO container, on the side of the offset, by a further amount (e.g. at least 1 cm or at least 2 cm), so that corresponding lashing straps can be attached here. Theoretically it is also conceivable to provide the fixing devices on the ends of the support beams. The fixing devices allow rapid and efficient fixing of the container to the pallet adapter kit. In one exemplary embodiment, the support beams are arranged on the cargo pallet so that they engage in recesses of the ISO container. Corresponding recesses may be provided on the ISO container to receive the forks of a forklift truck. According to the invention, these recesses can be used to create as secure a connection as possible via a form fit between the support beam and the ISO container. The support beams can also be arranged in these recesses, in order to create a pallet adapter kit which has a relatively small vertical extension. This means that despite the pallet adapter kit, the ISO container—and in particular its floor—is arranged in the region which lies relatively close to the top of the pallet, preferably directly on top of this. In this configuration it may be advantageous if the peg beams are arranged in front of and behind the ISO container in the longitudinal direction of the cargo pallet. To this extent, no space or only very little space need be provided for the pallet adapter kit between the top of the pallet and the underside of the ISO container. This space saving means that the offset of the ISO container transverse to the cargo pallet can be very small for the same container height.

In one exemplary embodiment, at least one of the support beams on its underside has at least one connection device for creating a form-fit and/or a force-fit connection to the aircraft cargo pallet. Preferably the connection device is suitable for creating a connection with a perforated rail. The connection device may be fixable pegs ("tension studs") as described for example in EP 0 581 072. The connection devices allow very rapid connection of the support beams to the aircraft cargo pallet. This connection is preferably configured such that it can also absorb tensile loads. To this extent, the lever forces resulting from the container offset can be transferred to the cargo pallet.

In one exemplary embodiment, the at least one fixing device of the support beam is arranged offset in relation to the at least one connecting device, in the longitudinal direction of the support beam, by at least 3%, in particular by at least 5%, in particular by at least 10% of the total length of the support beam.

In one exemplary embodiment, each of the support beams has two fixing devices and two connecting devices. A first offset of the first fixing device in relation to the first connection device may differ significantly from a second offset of the second fixing device in relation to the second connection device, so that the connection device is also freely accessible from above even when the containers are in place.

In one embodiment, the support beams and/or peg beams are configured such that they have a certain vertical extension. In this embodiment, the ISO container in the arranged state sits significantly above the cargo pallet, so that neither the beams nor the freight container are in contact with function units of the cargo deck, for example said centre guides, in the region of the offset. For example at least one beam of the plurality of beams may have a height which is greater than 2 cm or greater than 3 cm. As a whole, the freight container together with the beams preferably sits at a height of at least 5 cm, in particular at least 6 cm, since conventional function units of the cargo deck protrude around 2 to 4 cm above the loading level of the cargo deck.

The object cited above is furthermore achieved by a loading unit with a cargo pallet for an aircraft and with a pallet adapter kit, wherein the loading unit comprises:

- a peg at each pallet corner of the cargo pallets, wherein each peg is preferably configured such that the peg can be received by a container corner of an ISO container,
- at least two peg beams for receiving an ISO container, wherein each peg beam receives a pair of pegs and is preferably arranged on the cargo pallet transversely to the longitudinal direction of the cargo pallet, wherein the peg beams are configured and arranged such that the peg beams protrude beyond the cargo pallet on one side in the transverse direction.

Preferably the pallet adapter kit is configured as described above. Because of the offset in the transverse direction, the same or similar advantages apply as already explained. In particular the loading space available can be utilised substantially more flexibly without the need for time-consuming conversion measures.

A beam peg for receiving an ISO container can be arranged on a portion of at least one peg beam protruding beyond the cargo pallet in the transverse direction. This beam peg creates a form-fit connection to the ISO container and hence secures the load.

The loading unit can comprise an ISO container which is arranged on the peg beam offset to the cargo pallet in the transverse direction. The loading unit thus forms a unit of cargo pallet, peg beam and ISO container arranged accordingly on the peg beam.

The cargo pallet may comprise perforated rails for fixing preferably at least four, in particular at least six support beams. In one embodiment, at least two support beams are arranged between each pair of peg beams. The support beams serve for fixing of lashing straps and for better retention of the ISO container on the pallet.

A pair of support beams preferably has a spacing of 90 to 110 cm, or 140 to 160 cm. In one embodiment, the spacing amounts to around 100 cm or 150 cm. Conventional cargo decks have a plurality of function units for fixing aircraft cargo pallets to the cargo deck. Fixing pegs provided therefore frequently have a spacing of around 50 cm. Preferably at least the support beams are arranged on the cargo pallet such that they lie substantially centrally between the fixing lugs. In a corresponding configuration therefore the tensile loads are in each case transferred to two function units of the cargo deck. To this extent, a substantially higher payload—i.e. substantially heavier containers—can be transported.

The cargo pallet may comprise retractable pegs. Insofar as the pegs can be retracted into the cargo pallet, it is possible to transport other loads without problems.

The support beams and/or the peg beams may be arranged substantially symmetrically to a plane of symmetry running transversely to the longitudinal direction of the cargo pallet.

In one exemplary embodiment, the peg beams are arranged in front of and behind the ISO container in the longitudinal direction of the cargo pallet. Preferably, in this embodiment the pallet adapter kit comprises two support beams, each of which is arranged in a receiver running transversely to the longitudinal direction of the freight container.

Further advantageous embodiments arise from the dependent claims.

BRIEF DESCRIPTION OF THE DRAWINGS

The invention is described below with reference to several exemplary embodiments which will be explained in more detail with reference to drawings.

These show.

In the description which follows, the same reference numerals are used for parts which are the same and parts which have the same effect.

DETAILED DESCRIPTION

Figure 1:
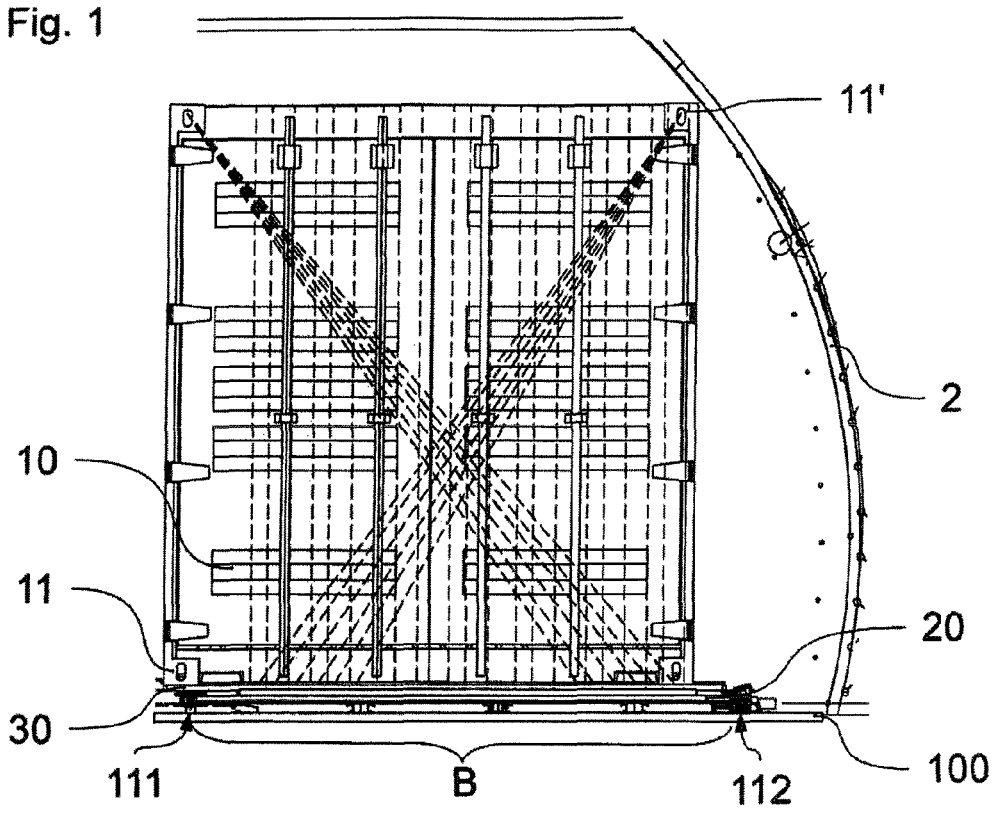
FIG. 1 a loading unit according to the invention, comprising a pallet adapter kit, a cargo pallet and an ISO container inside an aircraft cargo hold.
Figure 3:
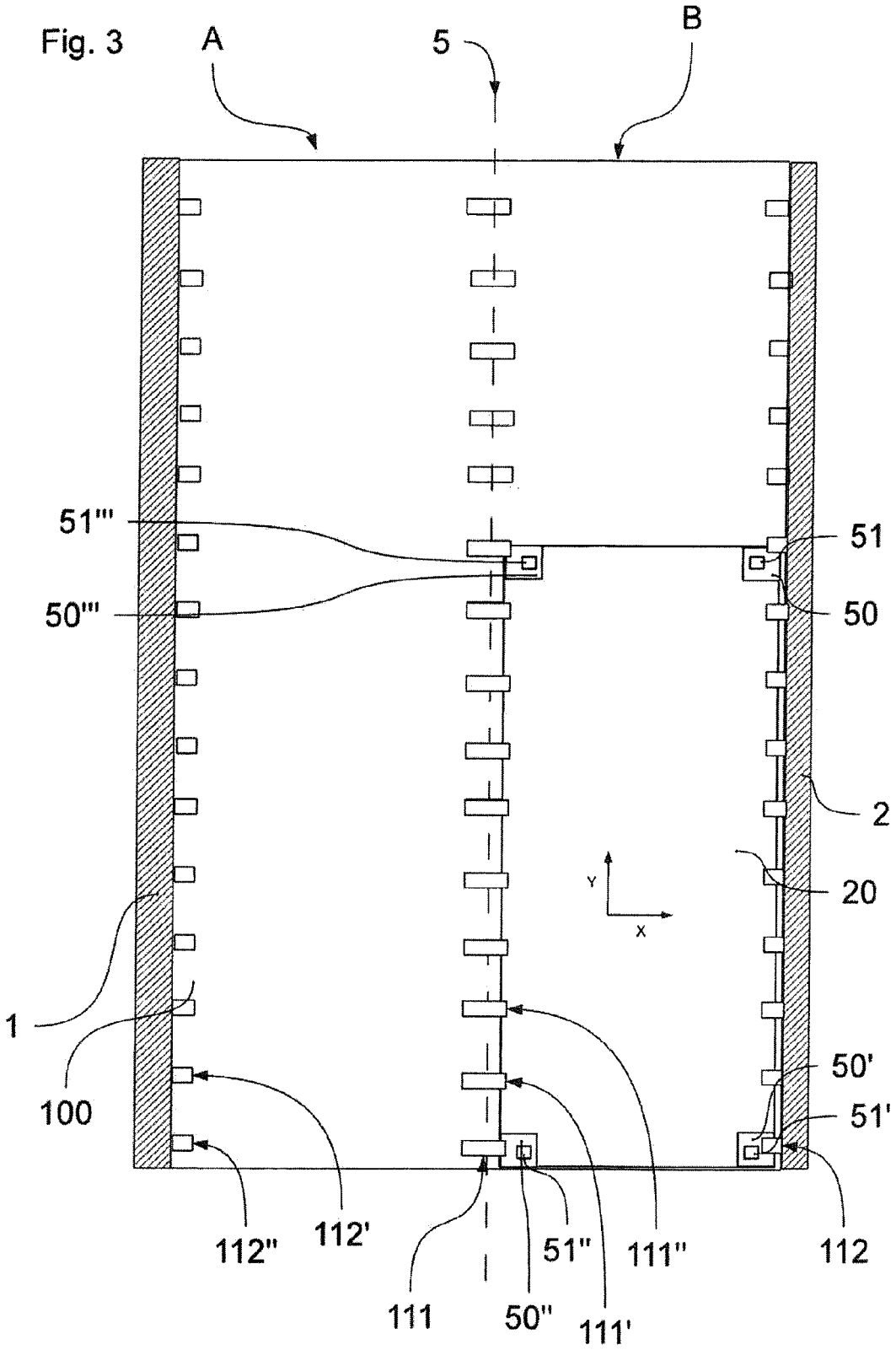
FIG. 3 a diagrammatic top view of a cargo deck fitted with a cargo pallet.

FIG. 1 shows an ISO container 10 loaded in a cargo hold of an aircraft. The hold has a cargo deck 100 on which a plurality of function units is arranged, in particular a centre guide 111 and a side guide 112. The hold is limited at the side by the right-hand side wall 2 of the aircraft. The centre guide 111 and the side guide 112, as shown in FIGS. 1 and 3, define a freight loading track B.

As shown in FIG. 1, the ISO container 10 is arranged offset to the freight loading track B to the left in the image plane. This offset arrangement allows the ISO container 10 to be loaded into the hold. It is clear that an arrangement inside the freight loading track B would lead to the upper right-hand container corner 11' protruding into the right-hand side wall 2 of the aircraft.

Figure 4:
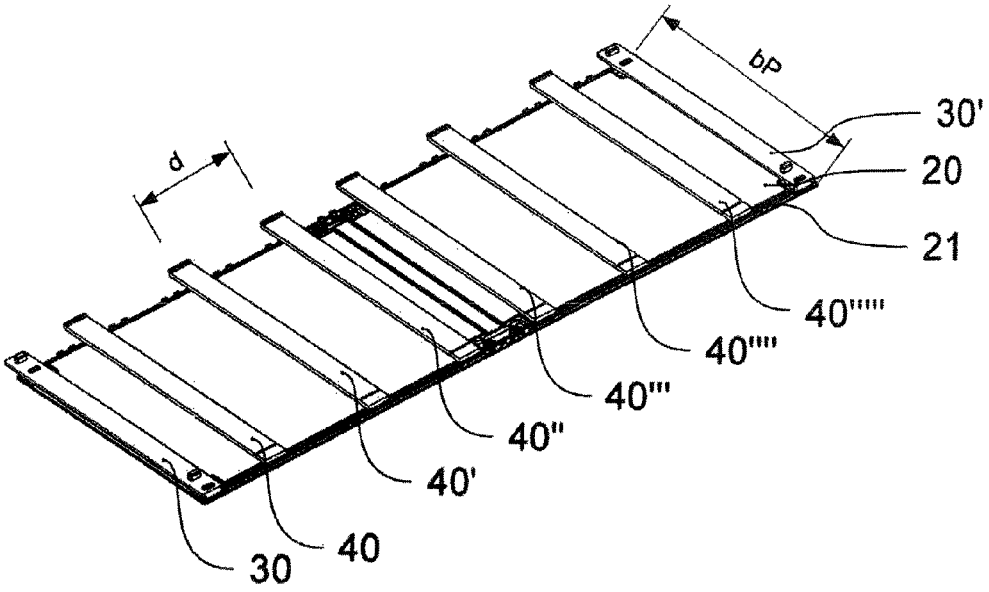
FIG. 4 a cargo pallet fitted with peg beams and support beams.

According to the invention, a cargo pallet 20 is arranged as usual inside the freight loading track B. This means that the cargo pallet 20 is clamped between the centre guide 111 and the side guide 112, and is held by these both in the transverse direction and in the vertical direction. The pallet adapter kit according to the invention is situated on the cargo pallet 20. As shown in FIG. 4, this has a plurality of beams. FIG. 1 shows a first peg beam 30 which is attached to the cargo pallet 20 and to the offset ISO container 10. Amongst others, the lower left-hand container corner 11 serves for fixing to the ISO container 10.

Figure 2:
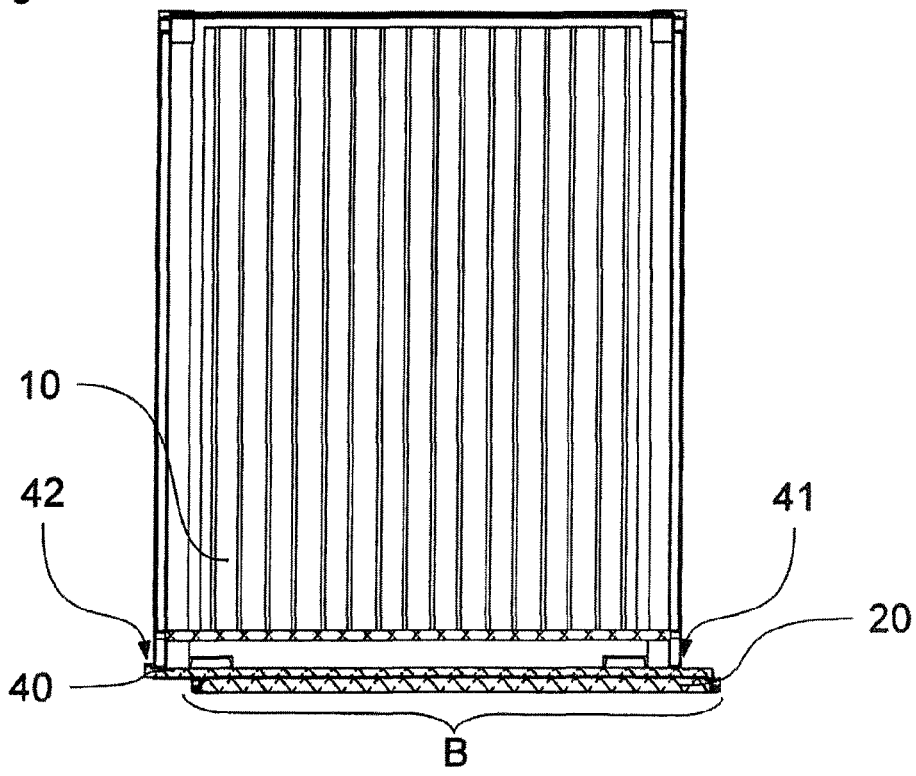
FIG. 2 a section through the loading unit in FIG. 1.

FIG. 2 shows a section through the loading unit according to the invention comprising the cargo pallet 20, the pallet adapter kit with the plurality of beams, and the ISO container 10. The section is selected such that it passes through the first support beam 40'''', 40''''' (see also FIG. 4). The support beams 40, 40', 40'', 40''', 40'''', 40''''' are also arranged and configured such that they protrude beyond the cargo pallet 20 (on the left in the image plane). The ISO container 10 lies over a wide area on the plurality of beams of the pallet adapter kit, in particular on the support beam 40 in FIG. 2. On the long side and on the right-hand side of the ISO container 10, perforated rails 41 and 42 are let into the support beam 40 and allow the attachment of securing nets and straps.

FIG. 3 shows a highly diagrammatic top view of the cargo deck 100.

The cargo deck 100 is limited by a left-hand side wall 1 and the right-hand side wall 2. Side guides 112, 112', 112'' and centre guides 111, 111', 111'' delimit freight loading tracks, in particular a freight loading track A (on the left) and the freight loading track B (on the right). The cargo deck 100 is constructed substantially symmetrically to plane of symmetry 5 running centrally through the centre guides 111, 111', 111''. The cargo pallet 20 with its four pallet corners 50, 50', 50'', 50''' lies inside the right-hand freight loading track B. In top view (FIG. 3), the cargo pallet 20 has a substantially rectangular form. The pallet longitudinal direction is designated below as Y and the pallet transverse direction as X. Each of the pallet corners 50, 50', 50'', 50''' is equipped with a pallet peg 51, 51', 51'', 51'''. These pallet pegs 51, 51', 51'', 51''' allows small ISO containers to be received inside the freight loading track B. In this "normal" loading state, the corresponding ISO container does not protrude beyond the cargo pallet 20.

According to the invention, the pallet pegs 51 and 51''' are received by a second peg beam 30', and the pallet pegs 51'' and 51' by the first peg beam 30. Because of the peg beams 30, 30', even large ISO containers 10 can be received in "offset" loading state, since these provide offset pallet pegs 51, 51', 51'', 51'''.

FIG. 4 shows diagrammatically the pallet adapter kit according to the invention arranged on a cargo pallet 20. Overall, this kit comprises eight beams according to FIG. 4, namely the first and second peg beams 30, 30' on the ends of the cargo pallet 20, and in-between the six support beams 40, 40', 40'', 40''', 40'''' and 40'''''.

The cargo pallet 20 shown in FIG. 4 is a 20-foot pallet. To take optimum account of the circumstances of the cargo deck 100, the second and third support beams are arranged with a spacing d of around 100 cm (distance between longitudinal axes of the beams). The first and second support beams 40, 40', the fourth and fifth support beams 40''', 40'''', and the fifth and sixth support beams 40'''', 40''''' also have a corresponding spacing d. This arrangement guarantees that, in a conventional final position of the cargo pallet 20 on the cargo deck 100, the support beams will come to lie centrally between adjacent side guides 112. Corresponding forces are therefore dissipated over several side guides 112, 112', 112''.

Figure 5:
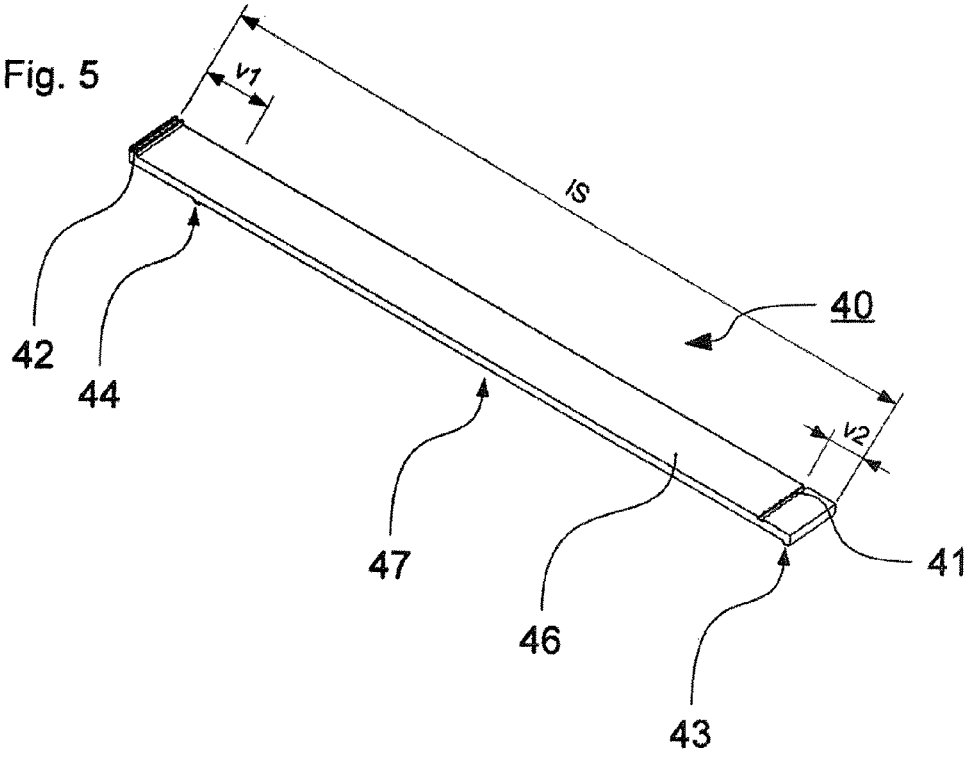
FIG. 5 a detail view of a support beam from FIG. 4.

FIG. 5 shows a view of a detail of the support beam 40. The support beam has a total length lS of around 260 cm. In contrast, the cargo pallet 20 has a width bP (see FIG. 4) of around 245 cm. The support beam 40 therefore protrudes beyond the cargo pallet 20 by around 15 cm.

The support beam 40 shown as an example in FIG. 5 has a top side 46 and in underside 47. Snap-lock closures 43, 44 are arranged on the right and left of the underside 47 and extend substantially over the entire width of the underside 47 These snap-lock closures 43, 44 are configured to engage in perforated rails (see the cargo pallet perforated rail 21 in FIG. 4). Effectively, the snap-lock closures 43, 44 create a form-fit connection. The snap-lock closures 43, 44 are spaced approximately 230 cm apart.

Perforated rails 41, 42 are situated on the top side 46 of the support beam 40 (see also FIG. 1). The first perforated rail 41 is arranged offset in relation to the first snap-lock closure 43 by around 15 cm (offset v1=15 cm). The second perforated rail 42 is arranged offset in relation to the second snap-lock closure 44 by around 25 cm (offset v2=25 cm). The first offset v1 and the second offset v2 therefore differ substantially, so that the perforated rails 41, 42 are accessible from above even after the arrangement of the ISO container 10 (see FIG. 1).

Figure 6:
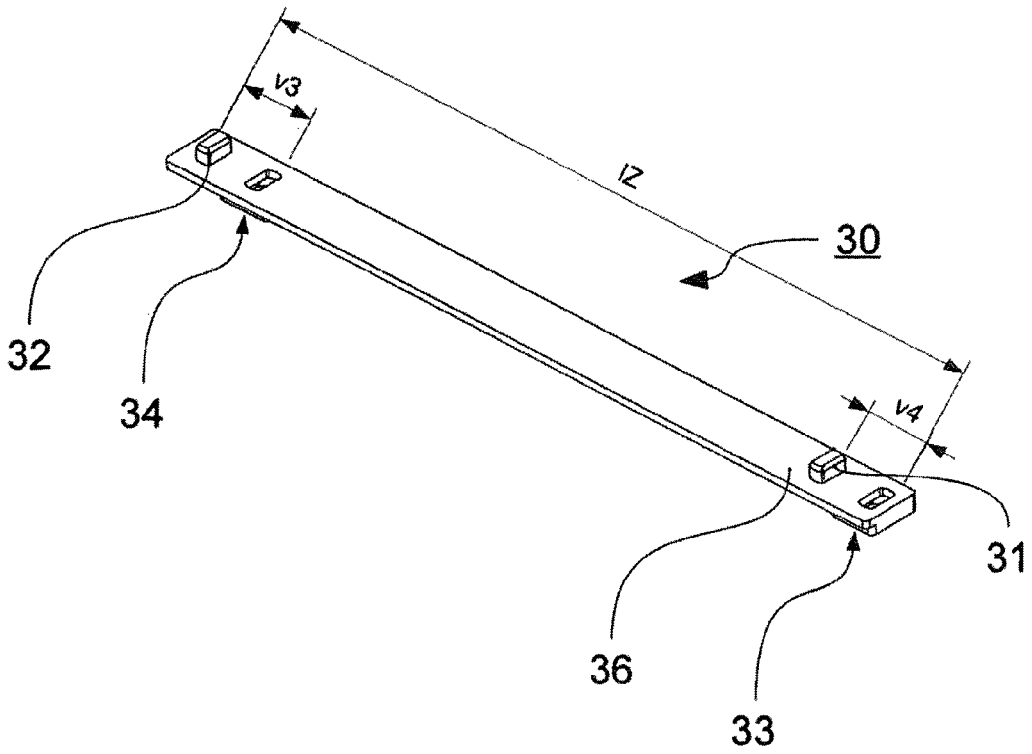
FIG. 6 a first detail view (top) of a support beam from FIG. 4.
Figure 7:
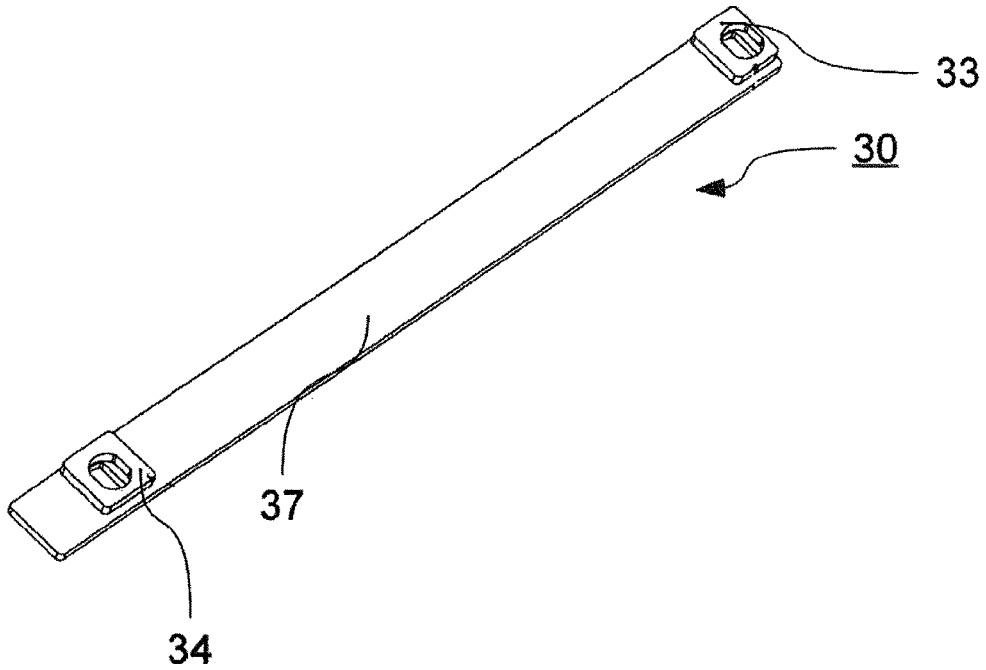
FIG. 7 a second detail view (underside) of a support beam from FIG. 4.

FIGS. 6 and 7 show views of details of the peg beam 30. On its underside 37, this has a first peg receiver 33 and a second peg receiver 34. On the top side 36 are a first peg 31 and the second peg 32. The total length (lZ) is around 258 cm. The first beam peg 31 is arranged offset in relation to the first peg receiver 33, and the second beam peg 32 is arranged offset in relation to the second peg receiver 34, by around 20 cm (offset v3=offset v4=20 cm).

Figure 8:
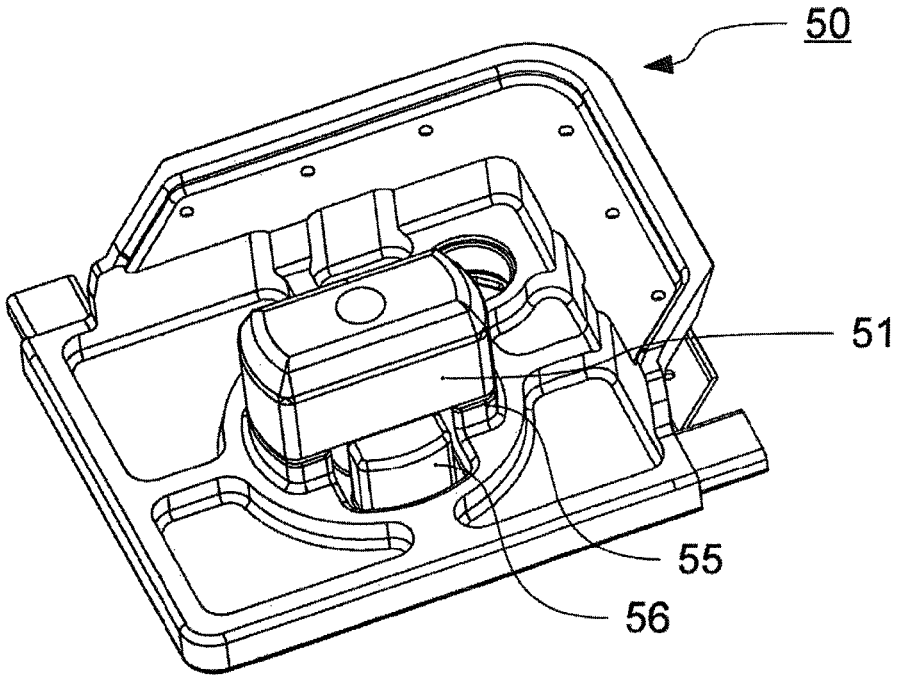
FIG. 8 a pallet corner with extended pallet peg.
Figure 9:
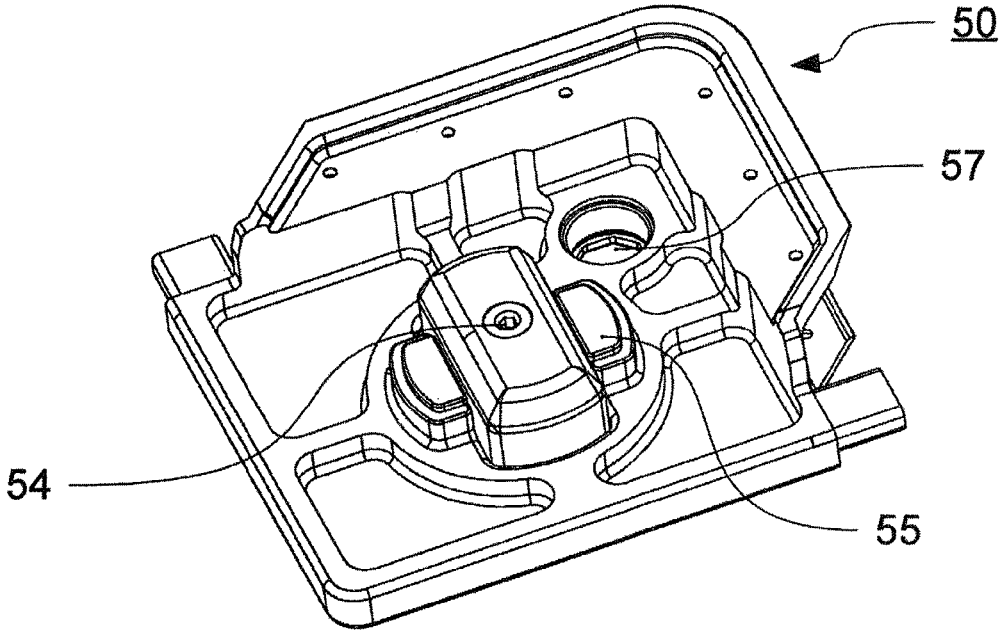
FIG. 9 the pallet corner from FIG. 8 with retracted peg.

FIGS. 8 and 9 show as an example a pallet corner 50 of the cargo pallet 20 from FIG. 4. The pallet corner 50 comprises a corner base plate 53, an interrupted web 55, and a pallet peg 51 mounted via a rotary joint 54. The pallet corner 50 can be moved into a raised position (FIG. 8) and a lowered position (FIG. 9). In the raised position (FIG. 8), the substantially cuboid pallet peg 51 is arranged so that it runs parallel to the web 55. The underside, or more precisely the lower side edges of the pallet peg 51, lies on the web 55.

In the lowered position (FIG. 9), the pallet peg 51 is twisted through 90°. In this position, side edges of the pallet peg 51 can engage in the recesses of the web 55 so that this can be lowered. As shown in FIG. 8, the pallet corner 50 has a guide web 56 on which the pallet peg 51 rests in the lowered position. For lowering, the width of the guide 57 is selected substantially less than that of the web 55, so that the guide 57 is received in the interior of the cuboid pallet peg 51.

Furthermore, a recess 57 is provided in the pallet corner 50, which allows the fitting of an RFID transponder. This RFID transponder can advantageously be used to identify the cargo pallet 20 and hence the cargo loaded thereon.

In the exemplary embodiments described, the form-fit connection between the cargo pallet 20 and the support beams 40, 40', 40", 40''', 40'''', 40''''' is created via snap-lock closures 43, 44. According to the invention, other connection means can also be selected. For example, a screw or a bolt may be used.

In the embodiments described, an ISO container 10 was arranged on a cargo pallet 20. According to the invention, it is possible to configure the pallet adapter kit such that several ISO containers 10 are anchored on the same cargo pallet 20. For example, for this instead of just two peg beams 30, 30', four peg beams 30, 30' may be provided. In the embodiment described (one ISO container 10), more than two peg beams 30, 30' may be used, for example three or four.

In the description above and in the claims, the peg beams 30, 30' each comprise at least one peg receiver 33, 34 to receive pallet pegs. According to the invention, this peg receiver 33, 34 may be greatly modified or omitted completely. Instead of the peg receiver 33, 34, a fixing device may be located on the peg beam 30, 30' which allows the respective peg beam 30, 30' to be connected to the cargo pallet 20. The fixing device can for example be a screw or a bolt. In one embodiment, the fixing device is suitable for creating a releasable connection, for example via a seat rail or perforated rail arranged on the cargo pallet 20. In one embodiment, the peg beams 30, 30' can then run parallel to the underside of the ISO container 10 (at the front and back of the ISO container 10) and in the region of the pallet projection, engage from below in the corners of the ISO container 10.

According to the invention, it would also be conceivable to omit the peg beams 30, 30' and only provide the support beams 40, 40', 40", 40''', 40'''', 40'''''. In one embodiment, these support beams 40, 40', 40", 40''', 40'''', 40''''' are then arranged inside recesses of the ISO container 10 which are provided for lifting by means of the forks of a forklift truck.

Theoretically, further fixings may be provided in order to create, in conjunction with the support beams 40, 40', 40", 40''', 40'''', 40''''', a force-fit connection between the ISO container 10 and the cargo pallet 20.

It should be pointed out here that all components described above (for example the peg beam 30, the support beam 40, the cargo pallet 20 or the pallet corner 50 according to FIGS. 8 and 9) are claimed as essential to the invention both alone and in any combination.

LIST OF REFERENCE NUMERALS

1 Left-hand side wall
2 Right-hand side wall
5 Plane of symmetry
10 ISO container
11, 11' Container corner
20 Cargo pallet
21 Cargo pallet perforated rail
30, 30' Peg beam
31, 32 Beam peg
33, 34 Peg receiver
36 Top side of peg beam
37 Underside of peg beam
40, 40', 40",
40''', 40'''', 40''''' Support beam
41, 42 Perforated rail
43, 44 Snap-lock closure ("tension stud")
46 Top side of support beam
47 Underside of support beam
50, 50', 50", 50''' Pallet corner
51, 51', 51", 51''' Pallet peg
53 Corner base plate
54 Rotary joint
55 Web
56 Guide
57 Receiver for RFID transponder
100 Cargo deck
111, 111', 111" Centre guide
112, 112', 112" Side guide
A, B Freight loading track
X Pallet transverse direction
Y Pallet longitudinal direction
bP Width of pallet
d Spacing
lS Length of support beam
lZ Length of peg beam
v1 to v4 Offset

The invention claimed is:

1. A pallet adapter kit for an aircraft cargo pallet including:

a plurality of beams each with a top side and an underside, wherein the plurality of beams comprise at least two peg beams, the underside of each peg beam including a first peg receiver and a second peg receiver each for receiving a peg of the aircraft cargo pallet, the top side of each peg beam including a first beam peg and a second beam peg for engagement with respective corners of an ISO container, wherein the first beam peg of each peg beam is arranged offset in relation to the first peg receiver of the peg beam or the second beam peg of each peg beam is arranged offset in relation to the second peg receiver of the peg beam in the longitudinal direction of the peg beam, wherein the plurality of beams additionally comprise at least one support beam with a top side and an underside, the support beam including a perforated rail for fixing lashing straps to the top side of the support beam, and wherein the plurality of beams are adapted to be arranged on the aircraft cargo pallet transverse to the longitudinal direction (Y) of the aircraft cargo pallet, and wherein the plurality of beams protrude beyond the aircraft cargo pallet on one side of the aircraft cargo pallet in the transverse direction (X).

2. The pallet adapter kit according to claim 1, wherein the first beam peg of each peg beam is arranged offset in relation to the first peg receiver of the peg beam or the second beam peg of each peg beam is arranged offset in relation to the second peg receiver of the peg beam, in the longitudinal direction of the peg beam, by at least 3 percent of the total length (lZ) of the peg beam.

3. The pallet adapter kit according to claim 1, wherein the peg receivers are configured to receive pegs which are identical in construction to the beam pegs of the peg beams.

4. The pallet adapter kit according to claim 1, wherein the support beam on the underside comprises at least one connection device for creating a form-fit connection to the aircraft cargo pallet.

5. The pallet adapter kit according to claim 4, wherein the perforated rail of the support beam is arranged offset in relation to the at least one connection device in the longitudinal direction of the support beam by at least 3 percent of the total length (IS) of the support beam.

6. The pallet adapter kit according to claim 1, wherein at least one beam of the plurality of beams has a height which is greater than 2 cm.

7. A loading unit for an aircraft, including:

a cargo pallet having a plurality of pallet corners, each pallet corner including a pallet peg adapted to be received in a container corner of an ISO container; and a pallet adapter kit including a plurality of beams adapted to receive the cargo pallet, each beam including a top side and an underside, the plurality of beams comprising at least two peg beams, each peg beam including a first peg receiver on the underside of the peg beam, a second peg receiver on the underside of the peg beam, a first beam peg on the top side of the peg beam, and a second beam peg on the top side of the peg beam, wherein the first beam peg is arranged offset in relation to the first peg receiver or the second beam peg is arranged offset in relation to the second peg receiver in the longitudinal direction of the peg beam, wherein the first peg receiver and the second peg receiver of each peg beam are adapted to respectively receive a pallet peg of the cargo pallet, and the first beam peg and the second beam peg of each peg beam are each adapted to be received in a container corner of the ISO container, wherein the peg beams are arranged on the cargo pallet transverse to the longitudinal direction (Y) of the cargo pallet, and wherein the peg beams protrude beyond the cargo pallet on one side of the cargo pallet in the transverse direction (X).

8. The loading unit according to claim 7, wherein the second beam peg of a peg beam is arranged on a portion of the peg beam that protrudes beyond the side of the cargo pallet in the transverse direction (X).

9. The loading unit according to claim 7 wherein the ISO container is arranged on the peg beams offset to the cargo pallet in the transverse direction (X).

10. The loading unit according to claim 7, wherein the cargo pallet comprises perforated rails for fixing at least 2 support beams.

11. The loading unit according to claim 7, wherein the plurality of beams comprise at least one pair of support beams attached to the cargo pallet such that the support beams have a mutual spacing (d) of 90 to 160 cm.

12. The loading unit according to claim 7, wherein the pallet pegs of the cargo pallet comprise retractable pegs.

13. The loading unit according to claim 7, wherein the beams are arranged substantially symmetrically to a plane of symmetry running transversely to the longitudinal direction (Y) of the cargo pallet.

* * * * *